US006808213B2

(12) United States Patent
Heller et al.

(10) Patent No.: US 6,808,213 B2
(45) Date of Patent: Oct. 26, 2004

(54) CLOSING DEVICE

(75) Inventors: Alexander Heller, Munchen (DE); Markus Gross, Raisting (DE)

(73) Assignee: Webasto Vehicle Systems International GmbH, Stockdorf (DE)

( * ) Notice: Subject to any disclaimer, the term of this patent is extended or adjusted under 35 U.S.C. 154(b) by 129 days.

(21) Appl. No.: 10/211,230

(22) Filed: Aug. 5, 2002

(65) Prior Publication Data

US 2003/0052488 A1 Mar. 20, 2003

(30) Foreign Application Priority Data

Aug. 6, 2001 (DE) ..... 101 37 800

(51) Int. Cl.[7] ..... E05C 3/06

(52) U.S. Cl. ..... 292/201; 292/216; 292/DIG. 43; 49/280

(58) Field of Search ..... 74/425, 424.77; 292/216, 201, DIG. 5, DIG. 43; 49/280

(56) References Cited

U.S. PATENT DOCUMENTS 4,272,125 A * 6/1981 Bienert et al. ..... 296/223
4,919,005 A * 4/1990 Schleicher ..... 74/501.6
5,301,987 A * 4/1994 Tokarz ..... 292/39
5,918,917 A * 7/1999 Elton ..... 292/201
6,024,404 A * 2/2000 Stallfort et al. ..... 296/223
6,155,614 A * 12/2000 Lange ..... 292/113
6,338,509 B1 * 1/2002 Rice et al. ..... 292/223

FOREIGN PATENT DOCUMENTS

DE 42 30 985 A1 4/1993

* cited by examiner

*Primary Examiner*—Gary Estremsky
(74) *Attorney, Agent, or Firm*—Nixon Peabody LLP; David S. Safran

(57) ABSTRACT

A closing device for doors, hatches, and similar closures of motor vehicles is provided which includes an electric motor as the drive device and a transmission device for transmitting a driving force to a sliding block of the closing device. The transmission device is a compression/tension cable which controls the opening and closing process of the closing device via the linear motion of the sliding block of a lock. The position of the sliding block controls the opening and closing state of the lock relative to a closing lever and a locking lever which are pivotally supported spaced apart from one another.

13 Claims, 3 Drawing Sheets

CLOSING DEVICE

BACKGROUND OF THE INVENTION

1. Technical Field

The present invention relates to a closing device, especially for doors, hatches, and the like, of motor vehicles, with an electric motor as the drive device and a transmission for transmitting the driving force to the closing device.

2. Description of Related Art

German Patent Publication 42 30 985 A1 discloses one example of a closing device. In this case, the transmission means consists of a wire which connects the motor to a catch bolt mechanism.

According to recent developments, trunk lids or rear hatches, especially in convertibles, in the course of design adaptation to their task of covering the stowage space for the removed convertible top, should have two laterally mounted locks. As a result, each lock includes an electric motor. However, the use of two motors has adverse effects with regard to space requirements.

SUMMARY OF THE INVENTION

Accordingly, one object of the present invention is to provide a closing device in which several locks can be easily actuated in a space-saving manner and in which each lock is made compact and reliable.

The above object, and other objects, are achieved by providing a closing device for doors and hatches of motor vehicles, comprising at least one lock including a sliding block; a drive device including an electric motor for generating a driving force for moving said sliding block; and a transmission means for transmitting a driving force to the sliding block. The transmission means is a compression/tension cable which controls the opening and closing process of the closing device via the linear motion of the sliding block of the block. In this configuration one or more locks can be actuated by a drive cable, since only one sliding block at a time can be moved. This actuation can also take place by several sliding locks located in succession on the drive cable in the assigned locks.

DETAILED DESCRIPTION OF THE PREFERRED EMBODIMENTS

Figure 1:
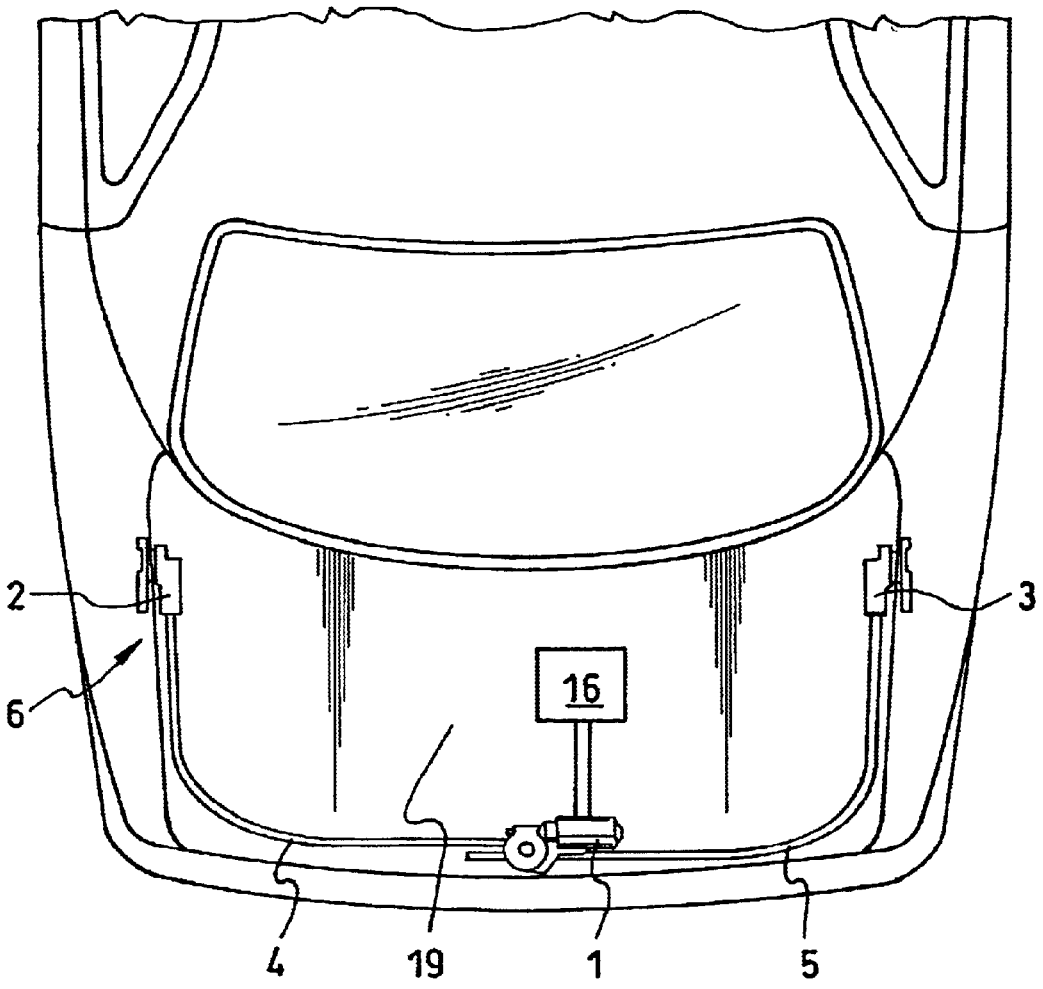
FIG. 1 shows in an overhead view the closing device of the present invention.

A closing device 6 of the present invention is described using the example of a rear hatch or trunk lid interlock, shown in FIG. 1, with two locks 2, 3. However, of course, the present invention is not limited to this particular example.

Figure 2A:
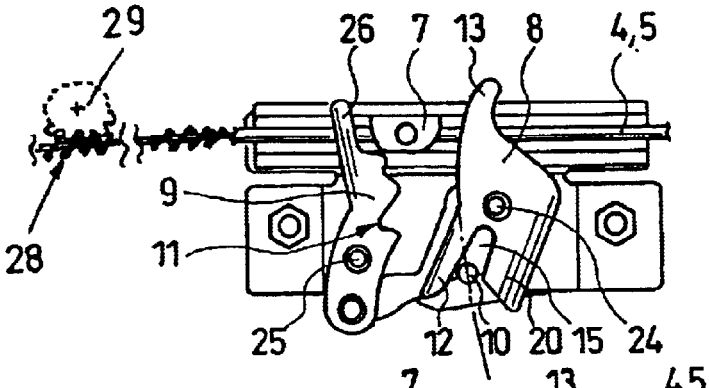
FIG. 2*a* shows in a side view the lock in the open position.

An electric motor 1 located on the rear hatch 19 actuates two compression/tension cables 4, 5 with its driving pinion 29 (FIG. 2*a*). The cables 4, 5 are known from conventional sliding roof drives and are provided with an outer spiral 28 for engaging the drive pinion 29. The locks 2, 3 are each mounted laterally on the bottom of the rear hatch 19 and each fits into a locking bolt 10 which is located on the body side (see FIGS. 2*a*–2*e*) and made, for example, as a bolt-, journal, clip- or ring-shaped element. An electrical or electronic control 16, mounted, for example, in the vehicle interior for actuation by the driver, actuates the electric motor 1 in the desired manner.

In FIGS. 2*a*–2*e*, the different operating positions of each lock 2, 3 are shown individually. Depending on the drive direction, one sliding block 7 at a time is pushed linearly via the compression/tension cable 4, 5 either in the direction of a locking lever 9 or in the direction of a closing lever 8. When the control 16 is not actuated, the sliding block 7 is moved into the neutral position (see FIGS. 2*a*, 2*b*, and 2*d*).

Figure 2B:
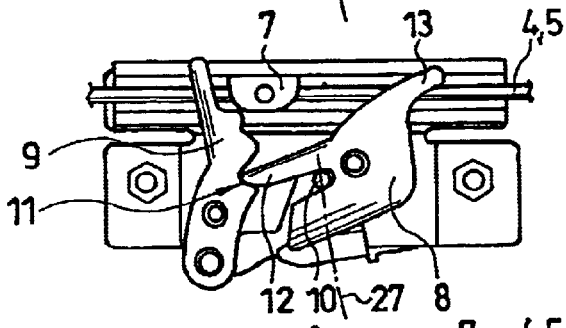
FIG. 2*b* shows in a side view the lock in the preliminary catch position.
Figure 2C:
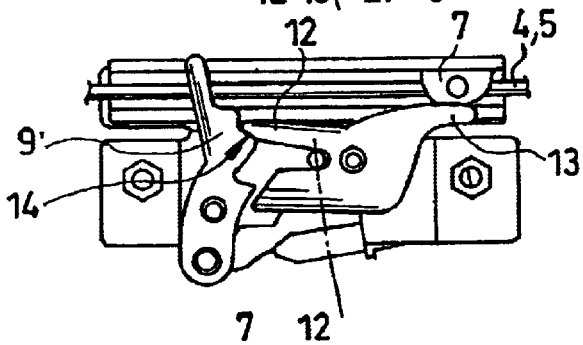
FIG. 2*c* shows in a side view the lock actuated in the closed position.
Figure 2D:
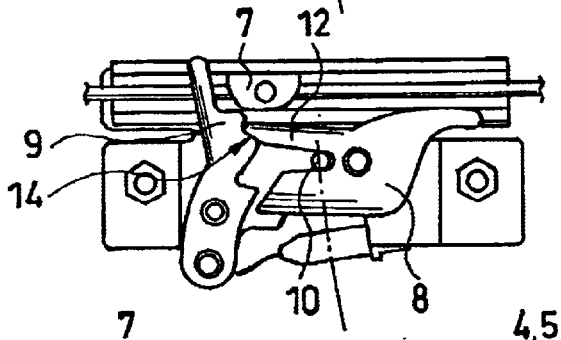
FIG. 2*d* shows in a side view the lock in the closed position.
Figure 2E:
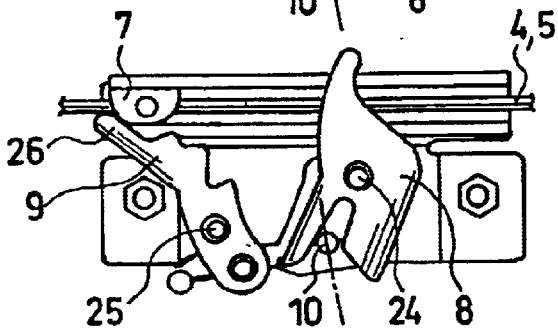
FIG. 2*e* shows in a side view the lock when being actuated to open.
Figure 3:
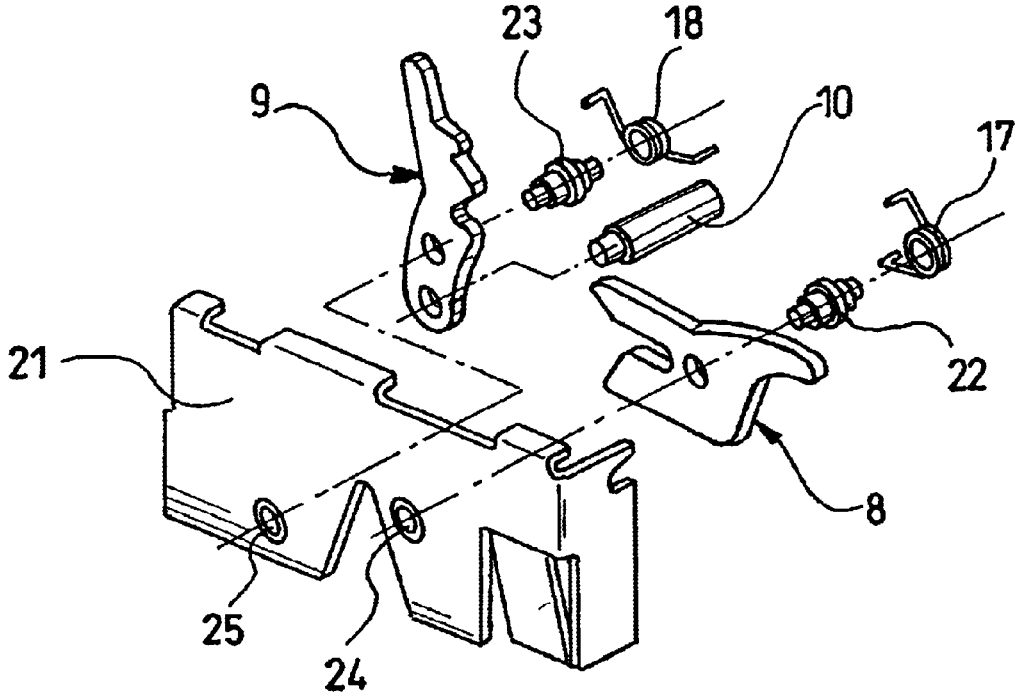
FIG. 3 shows parts of the lock in an exploded view.

FIG. 3 shows a partial view of the details of the lock 2, 3. Between two lock cages 21 (only one is shown), the two levers 8, 9 are pivotally mounted in respective bearings 24, 25 by means of two journals 22, 23. The closing lever 8 is pretensioned by a spring 17 (counterclockwise in FIGS. 2*a*–2*e*) such that when not actuated it is held in the open position by the sliding block 7 (FIGS. 2*a* and 2*e*). A spring 18 tensions the locking lever 9 clockwise and when not actuated by the sliding block 7 in the closed position (FIGS. 2*a*–2*d*).

FIG. 2*a* shows the lock 2, 3 in the open position. The closing lever 8 and the locking lever 9 are roughly vertical, i.e. perpendicular to the cable 4, 5. The body-side locking journal 10 is in the released position, since it is not held in the gap 15 of the closing lever 8. The closing lever 8 has two actuating journals 12 and 13 which are roughly opposite relative to the swiveling axis 24. The gap 15 is located between the lower actuating journal 12 and another arm 20.

FIG. 2*b* shows the lock 2, 3 in the preliminary catch position which can be set, for example, by pressing down the trunk lid 19. The sliding block 7 remains in its neutral position and the locking journal 10 is accommodated in the gap 15 and kept from emerging along the path of its motion 27 shown by the broken line. The closing lever 8, with its actuating journal 12, fits into a first lower catch 11 of the locking lever 9.

The actuation of the lock 2, 3 for adjusting the closed position is shown in FIG. 2*c*. The sliding block 7 is pushed to the right by means of the compression/tension cable 4, 5 until it swivels the closing lever 8 in contact with the upper actuating journal or lever arm 13 and brings it into the horizontal position, i.e parallel to the moving path of the sliding block 7 and to the position of the drive cable 4, 5. In doing so the actuating journal 12 of the closing lever 8 fits into a second upper catch 14 of the locking lever 9, by which the lock 2, 3 is blocked.

Afterwards, the sliding block 7 is moved again in opposite motion into the neutral position (FIG. 2*d*). The lock is in the closed position with the closing lever 8 remaining in the horizontal position (horizontal, with respect to the described arrangement and the representation, corresponds to a position parallel to the drive cable 4, 5).

To reach the open position, the sliding block 7 is moved into the left-hand position which is shown in FIG. 2*e* by the corresponding actuation of the control 16 via the electric motor 1 and the cable 4, 5. In doing so the sliding block 7 presses against the upper lever arm 26 of the locking lever 9, by which it is swiveled such that the actuating journal 12 of the closing lever 8 disengages from the upper catch 14 of the locking lever 9. The closing lever 8 swivels into the vertical open position due to the pretensioning of the spring 17 and releases the locking journal 10. After the sliding block 7 moves back into the neutral position, the locking lever 9 likewise swivels into the vertical position due to the pretensioning of the spring 18 (FIG. 2*a*). Thus the lock is again in the initial position.

It is apparent from the preceding description that the closing device of the present invention allows one, two or more locks to be actuated at the same time with high reliability and with low structural cost.

We claim:

1. A closing device for doors and hatches of motor vehicles, comprising:

at least one lock including a sliding block;

a drive device including an electric motor for generating a driving force for moving said sliding block;

a transmission means for transmitting a driving force to the sliding block, said transmission means including a compression/tension cable to control an opening and closing process of the closing device via linear motion of said sliding block;

a closing lever and a locking lever both pivotally supported and spaced apart from one another, wherein a position of the sliding block, relative to the closing lever and the locking lever, controls the opening and closing process of the lock, and wherein the closing lever includes an actuating journal such that, with the sliding block being in its neutral position, the lock is positionable in a preliminary catch position in which the closing lever holds a body-side locking bait while the actuating journal fits into a first catch of the locking lever.

2. The closing device of claim 1, wherein the sliding block is in a neutral position both in a closed position and also in an open position of the lock.

3. The closing device of claim 1, wherein, to adjust the closed position of the lock, the sliding block is movable in the direction of the closing lever to push the closing lever by means of an upper lever arm into approximately a horizontal position parallel to a moving path of the sliding block so that the actuating journal of the closing lever fits securely into a second catch of the locking lever and in doing so moves the locking bolt by holding the closing lever in a blocked position to permit the sliding block to be moved again into the neutral position.

4. The closing device of claim 3, wherein said closing lever is spring-pretensioned, and wherein, to actuate the open position, the sliding block is moved in the direction of the locking lever to swivel the locking lever such that the actuating journal of the closing lever disengages from the second catch and the closing lever swivels into a position perpendicular to the compression/tension cable and releases the locking bolt to permit the sliding block to be moved again into the neutral position.

5. A closing device for doors and hatches of motor vehicles, comprising:

at least one lock including a sliding block;

a drive device including an electric motor for generating a driving force for moving said sliding block;

a transmission means for transmitting a driving force to the sliding block, said transmission means including a compression/tension cable to control an opening and closing process of the closing device via linear motion of said sliding block;

a closing lever and a locking lever both pivotally supported and spaced apart from one another, wherein a position of the sliding block, relative to the closing lever and the locking lever, controls the opening and closing process of the lock, and wherein the closing lever and the locking lever are both spring pretensioned, the spring pretensioning of the closing lever holding the closing lever in a vertical position perpendicular to the compression/tension cable for maintaining the open position of the lock, the spring pretensioning of the locking lever maintaining the locking lever in a vertical position perpendicular to the compression/tension cable to maintain the closed position of the lock.

6. A closing device for doors and hatches of motor vehicles, comprising;

at least one lock including a sliding block;

a drive device including an electric motor for generating a driving force for moving said sliding block;

a transmission means for transmitting a driving force to the sliding block, said transmission means including a compression/tension cable to control an opening and closing process of the closing device via liner motion of said sliding block;

a closing lever and a locking lever both pivotally supported and spaced apart from one another, wherein the closing lever engages a body-side locking bolt and wherein a position of the sliding block, relative to the closing lever and locking lever, controls the opening and closing process of the lock.

7. The closing device of claim 6, wherein an electric control controls the electric motor to displace the sliding block.

8. The closing device of claim 6, wherein the at least one lock includes at least two locks actuated by the electric motor.

9. The closing device of claim 6, wherein the compression/tension cable includes an outer spiral for engaging a driving pinion of the electric motor.

10. The closing device of claim 8, wherein the electric motor actuates the at least two locks one at a time via two compression/tension cables.

11. The closing device of claim 6, wherein the sliding block controls the opening and closing process of the lock by directly actuating the closing lever and the locking lever, respectively.

12. The closing device of claim 6, wherein, both in a closed position and in an open position of the lock, the sliding block is in a neutral position without actuating either the closing lever or the locking lever.

13. The closing device of claim 11, wherein, both in a closed position and in an open position of the lock, the sliding block is in a neutral position without actuating either the closing lever or the locking lever.

* * * * *